US007627932B2

(12) United States Patent
Rübenach

(10) Patent No.: US 7,627,932 B2
(45) Date of Patent: Dec. 8, 2009

(54) APPARATUS FOR PRODUCING A WEB OF FIBRE MATERIAL

(75) Inventor: Bernhard Rübenach, Mönchengladbach (DE)

(73) Assignee: Fleissner GmbH, Egelsbach (DE)

( * ) Notice: Subject to any disclaimer, the term of this patent is extended or adjusted under 35 U.S.C. 154(b) by 867 days.

(21) Appl. No.: 11/205,217

(22) Filed: Aug. 17, 2005

(65) Prior Publication Data

US 2006/0048342 A1 Mar. 9, 2006

(30) Foreign Application Priority Data

Aug. 30, 2004 (DE) ..... 10 2004 042 119

(51) Int. Cl.
*D01H 5/00* (2006.01)

(52) U.S. Cl. ..... 19/236; 19/105

(58) Field of Classification Search ..... 19/105, 19/236

See application file for complete search history.

(56) References Cited

U.S. PATENT DOCUMENTS

| | | | | |
|---|---|---|---|---|
| 4,574,433 | A * | 3/1986 | Brunnschweiler | 19/105 |
| 5,014,395 | A * | 5/1991 | Staheli et al. | 19/105 |
| 5,052,080 | A * | 10/1991 | Grundler | 19/65 A |
| 5,303,455 | A | 4/1994 | Leifeld | |
| 6,216,318 | B1 | 4/2001 | Leifeld | |
| 6,263,545 | B1 | 7/2001 | Pinto | |
| 2002/0124354 | A1 * | 9/2002 | Pferdmenges et al. | 19/105 |

FOREIGN PATENT DOCUMENTS

| | | | |
|---|---|---|---|
| DE | 38 21 238 | A1 | 12/1989 |
| DE | 40 36 014 | A1 | 5/1992 |
| DE | 101 40 864 | A1 | 3/2003 |
| EP | 0 347 715 | B1 | 12/1989 |
| EP | 1 126 056 | A1 | 8/2001 |
| FR | 2 669 043 | A1 | 5/1992 |
| FR | 2 779 774 | A1 | 12/1999 |
| FR | 2 828 895 | A1 | 2/2003 |
| WO | WO 02/101130 | A1 | 12/2002 |
| WO | WO 2004/013390 | A1 | 2/2004 |

OTHER PUBLICATIONS

French Patent Office Preliminary Search Report, dated Sep. 20, 2007, issued on French Application No. 05 08861.

* cited by examiner

*Primary Examiner*—Shaun R Hurley
(74) *Attorney, Agent, or Firm*—Venable LLP; Robert Kinberg; Leigh D. Thelen

(57) ABSTRACT

In an apparatus for producing a fiber web, for example of cotton, synthetic fibers or the like, a web-former and/or a web-bonder is/are arranged downstream of a flock feeder device and the fiber material is conveyable. In order to make it possible by simple means to produce a uniform fiber web, a drafting device is arranged between the flock feeder device, on the one hand, and the web-former and/or the web-bonder, on the other hand, for drafting of the flock material.

30 Claims, 6 Drawing Sheets

APPARATUS FOR PRODUCING A WEB OF FIBRE MATERIAL

CROSS REFERENCE TO RELATED APPLICATION

This application claims priority from German Patent Application No. 10 2004 042 119.6 filed Aug. 30, 2004, the entire disclosure of which is incorporated herein by reference.

BACKGROUND OF THE INVENTION

The invention relates to an apparatus for producing a non-woven web, for example of cotton, synthetic fibres or the like.

In practice, fibre webs are produced in different ways depending on the intended use, although in all cases a flock feeder (flock supply) is arranged upstream of a subsequent processing machine. In certain known forms of apparatus, a web-former and/or a web-bonder is/are arranged downstream of a flock feeder device and the fibre material is conveyable. For producing a non-woven web, a roller card or an aerodynamic web-former are suitable for use as the web-forming processing machine. The fibre web thereby formed can subsequently be bonded. The non-woven web can also be produced by directly coupling the flock feeder to a web-bonder, for example a needling machine, a hydroentanglement bonder or a thermal bonder. In such cases, the flock feeder is used as the web-former, downstream of which there is provided a web-bonder.

After the flock feeder it is not possible for the fibre material to be made more uniform in the aerodynamic web-former or in the web-bonders. It is especially disadvantageous that between the flock feeder and the processing machine the fibre flock material is subject to uncontrolled compaction and drafting influences.

It is an aim of the invention to provide an apparatus of the kind mentioned at the beginning that avoids or mitigates the mentioned disadvantages and that especially makes it possible by simple means to produce a uniform non-woven web.

SUMMARY OF THE INVENTION

The invention provides an apparatus for producing a fibre web, comprising:

- a flock-feeding device
- a web-forming device
- a drafting device arranged between the flock-feeding device and the web-forming device for drafting fibre material that, in use, is conveyed from the flock-feeding device to the web-forming device.

As a result of the fact that the flock material is drafted in suitable manner, flock material having a desired flock weight ($g/m^2$) is supplied to the processing machine provided downstream of the flock feeder device. The drafting can advantageously be closed-loop controlled, in which case a prespecified, desired weight per unit area is maintained and, as a result, a uniform flock feed is produced for the processing machine. In accordance with a further embodiment, the drafting can be open-loop controlled, in which case prespecified lighter or heavier web weights, depending on the application, are produced. Both closed-loop controlled and open-loop controlled drafting may be used in combination without any problem. A further advantage is that it is possible to modify the orientation of the fibre layers in the fibre flock feed.

The drafting device may comprise driven rollers. The circumferential speeds of the rollers may increase in the work direction. Advantageously, a drafting mechanism having at least two co-operating roller pairs is used. The roller pairs may be arranged after one another. Advantageously, the roller pairs are arranged in a horizontal or inclined direction. The rollers are advantageously arranged such that the fibre material passes through the roller nip of the roller pair. The drafting device may comprise a 2-over-2 drafting mechanism. The drafting device may comprise a 3-over-3 drafting mechanism. Advantageously, at least one pressure bar is provided in at least one drafting zone. Advantageously, the drafting mechanism is an autoleveller drafting mechanism. Advantageously, there is at least some closed-loop and/or open-loop control of the speed of rotation of the roller pairs. Advantageously, the delivery rollers of the flock feeder device are the intake rollers of the drafting mechanism. Two upper rollers may be associated with one lower roller. Two lower rollers may be associated with one upper roller. In another embodiment, at least two rollers arranged one after the other are provided. Advantageously, the fibre material passes through the roller nip of the rollers arranged one after the other. The fibre material may at least partly loop around the roller surface. Advantageously, the fibre material loops around the surfaces of neighbouring rollers on different sides. Advantageously, the fibre material is drafted on different sides on neighbouring rollers. Drafting of the fibre material on a roller may be different on the surface that faces the roller and on the surface that is remote from the roller. The rollers arranged one after the other may be arranged in a vertical or inclined direction. The rollers of the drafting device may be, at least in part, biased. The drafting device may be used for pre-bonding of the fibre material. Advantageously, an electrical control and/or regulation device having a desired value setter is associated with the drafting device. Advantageously, a control and/or regulation device having a measuring device for the flock material mass and an actuating device are associated with the drafting device. Advantageously, the actuating device is an adjustable-speed motor for driving at least one roller of the drafting device. Advantageously, the adjustable-speed motors are capable of modifying the draft between the roller pairs of the drafting mechanism. There may be closed-loop-controllable motors capable of modifying the drafting between the roller pairs arranged after one another. In one embodiment of the invention the weight per unit area of a flock web can be regulated. In another embodiment of the invention the weight per unit area of a non-woven web can be regulated. Advantageously, the apparatus comprises a web-bonder, for example, a needling machine, a thermofusion device, a spunlace device, or a hydroentanglement bonding device. In one preferred embodiment, a web-forming device, for example, a roller card or an aerodynamic web-former, is arranged downstream of the drafting device. Advantageously, the intake rollers of the drafting device have a circumferential speed of 1 to 35 meters per minute (m/min), preferably 10 to 20 m/min. Advantageously, the degree of drafting in the drafting apparatus is 1.5 to 4 times.

The invention also provides an apparatus for producing a fibre web, for example of cotton, synthetic fibres or the like, wherein a web-former and/or a web-bonder is/are arranged downstream of a flock feeder device and the fibre material is conveyable, wherein a drafting device is arranged between the flock feeder device, on the one hand, and the web-former and/or the web-bonder, on the other hand, for drafting of the flock material.

DETAILED DESCRIPTION OF CERTAIN PREFERRED EMBODIMENTS

Figure 1:
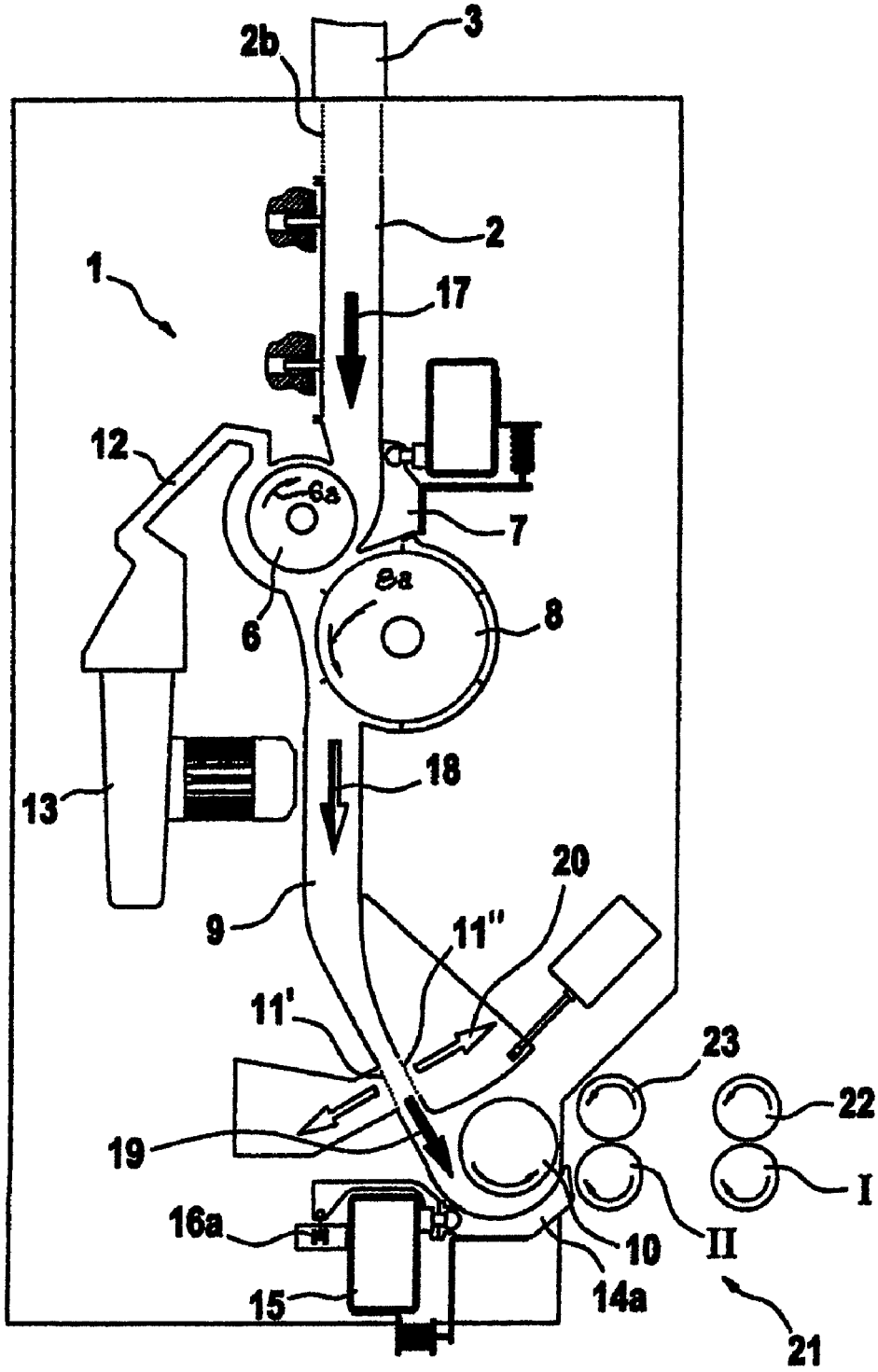
FIG. 1 is a diagrammatic side view of an apparatus according to the invention having a flock feeder and a downstream flock drafting mechanism.

In the embodiment of FIG. 1, a flock feeder 1 is provided with a vertical reserve shaft 2, which is fed from the top with finely dispersed fibre material. Feeding can be accomplished, for example, by means of a supply and distribution line 3 by way of a condenser. Provided in the upper region of the reserve shaft 2 are air outlet apertures 2*b*, through which the transporting air passes into a venting device after separation from the fibre flocks 17. The lower end of the reserve shaft 2 is closed by an intake roller 6, which co-operates with an intake trough 7. That slow-speed feed roller 6 supplies the fibre material from the reserve shaft 2 to a high-speed opener roller 8 located below, which is provided with pins or saw-tooth wire and is in communication at part of its circumference with a lower feed shaft 9. The opener roller 8, which revolves in the direction of arrow 8*a*, conveys the fibre material 18 that it picks up, into the feed shaft 9. The feed shaft 9 has, at its lower end, a feed roller 10 (delivery roller), which revolves in accordance with the arrow shown. This flock feeder 1 can be, for example, a SCANFEED TF flock feeder from the Trützschler company, Mönchengladbach, Germany. The intake roller 6 rotates slowly in clockwise direction (arrow 6*a*) and the opener roller 8 rotates in anti-clockwise direction (arrow 8*a*) so that a contrary direction of rotation is brought about. The walls of the lower part of the feed shaft 9 are provided, up to a certain height, with air outlet apertures 11', 11". At the top, the feed shaft 9 is in communication with a box-shaped space 12, one end of which is connected to the outlet from a fan 13. As a result of the revolving intake roller 6 and the revolving opener roller 8, a specific amount of fibre material 18 per unit time is conveyed continuously into the feed shaft 9, and an identical amount of fibre material 19 is conveyed out from the feed shaft 9 by the feed roller 10, which co-operates with a feed trough 14 comprising a plurality of individual troughs 14*a* to 14*n*, and is fed to the drafting mechanism 21. In order to keep that amount constant and to compact it uniformly, a flow of air is applied to the fibre material in the feed shaft 9 by means of the fan 13 by way of the box-shaped space 12. Air is drawn into the fan 13 and is forced out through the fibre mass located in the feed shaft 9, the air 20 then emerging from the air outlet apertures 11', 11" at the lower end of the feed shaft 9. Associated with the lower end of the wall 9*a* of the feed shaft 9 is a support 15 (cross-beam), for example made of structural steel, to which the feed troughs 14*a* to 14*n* are pivotally connected across the width. Associated with each feed trough 14*a* to 14*n* (only 14*a* is shown) is an inductive displacement sensor 16*a* to 16*n* (only 16*a* is shown).

Arranged immediately downstream of the flock feed unit comprising the feed roller 10 and feed trough 14 (feed table) is a drafting device in the form of a 2-over-2 drafting mechanism 21. The drafting mechanism 21 has two upper rollers 22, 23 and two lower rollers I, II, the directions of rotation of which are indicated by curved arrows.

Figure 2:
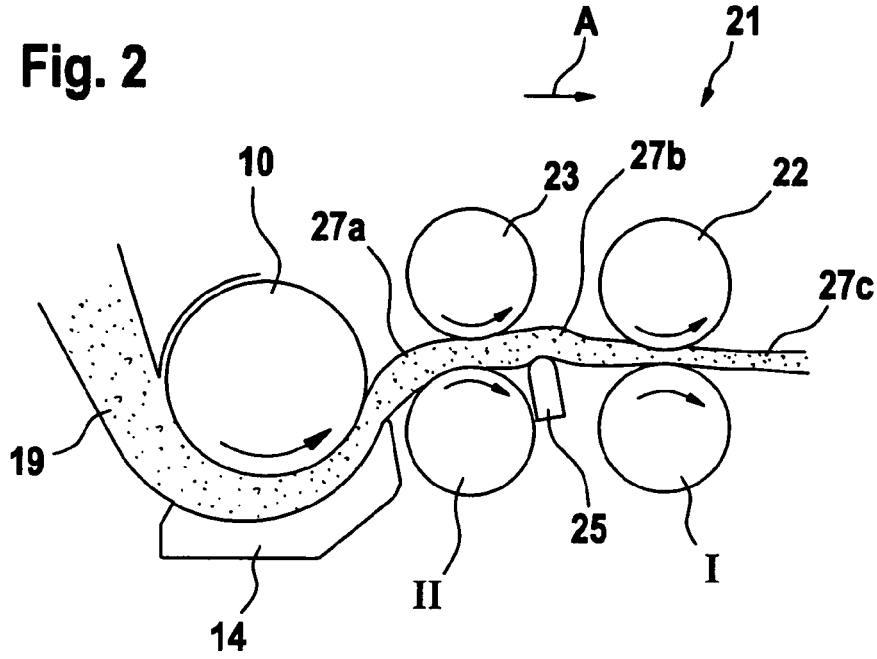
FIG. 2 shows the drafting mechanism of FIG. 1, having a pressure bar in the drafting zone underneath the fibre flock material.

One suitable form of drafting device is shown in FIG. 2. In the drafting zone between the intake roller pair 23/II and the delivery roller pair 22/I there is arranged a pressure bar 25, over the upper, rounded-off end region of which the fibre flock web 27*b* runs, in contact therewith. The fibre flock web 27 in the form of a non-drafted fibre flock web 27*a* is introduced into the roller nip of rollers 23/II and is delivered from the roller nip of rollers 22/I in the form of a drafted fibre flock web 27*c*. The circumferential speed of the rollers 22/I is, for example, 22.5 m/min and that of the rollers 23/II is, for example, 15 m/min so that the degree of drafting is 1.5 times. As a result of the contact pressure of the loaded roller pairs 22/I and 23/II, the loose non-drafted fibre flock web 27*a* becomes a pre-bonded fibre flock web 27*b* and 27*c*. The pressure bar 25 ensures controlled guidance of even the short fibres.

Figure 3:
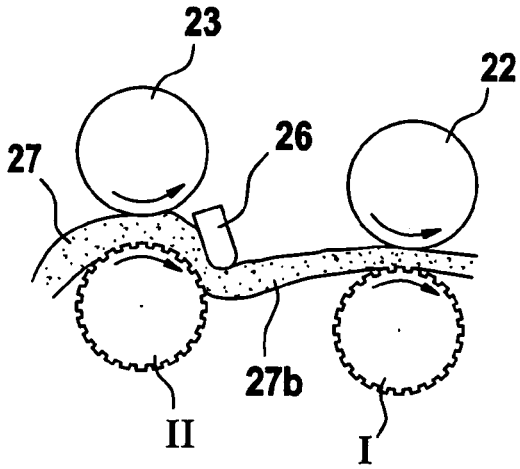
FIG. 3 shows a 2-over-2 drafting mechanism, having a pressure bar above the fibre flock material and having fluted lower rollers.

Another suitable drafting device is shown in FIG. 3, in which the fibre flock web 27*b* runs underneath the pressure bar 26, which presses against the fibre flock web 27*b*. The lower cylinders I and II have technologically optimised spiral fluting (surface contouring).

Figure 4:
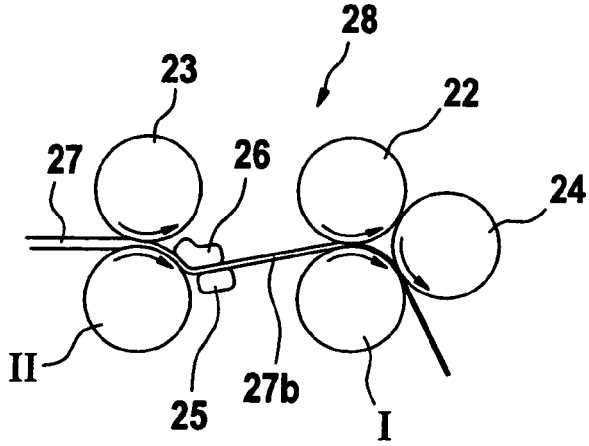
FIG. 4 shows a 3-over-2 drafting mechanism having two planar pressure bars, one above and one underneath the fibre flock material.

In yet another form of suitable drafting device, shown in FIG. 4, in the drafting zone of a 3-over-2 drafting mechanism 28 (see rollers 22, 24 and I), a pressure bar 26 is arranged above, and a pressure bar 25 is arranged below, the fibre flock web 27*b*. The pressure bars 25 and 26 are of flat construction in the region of fibre contact. As a result of the fibre flock web 27*b* lying on the pressure bar 25, the latter supports the fibre flock web 27*b* from below, it also being possible for the supporting surface to be made longer (not shown) in the work direction.

Figure 5:
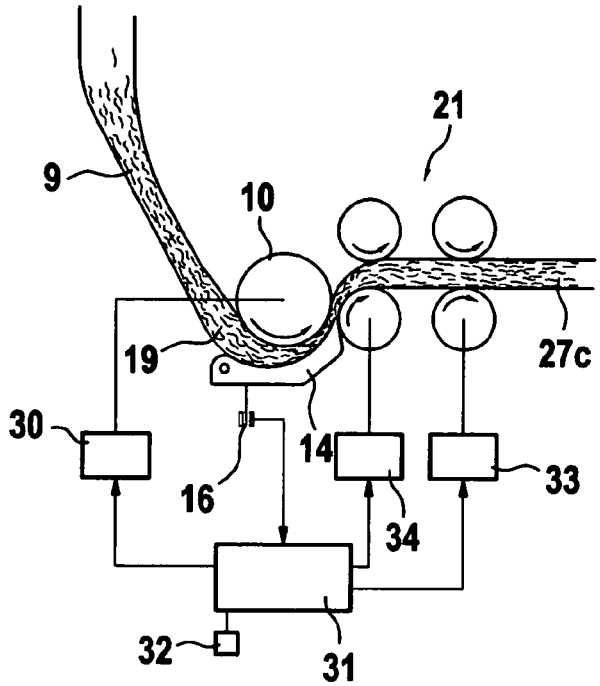
FIG. 5 shows the feed device of a flock feeder, a flock drafting mechanism arranged immediately downstream of the feed device, the fibre material and the generalised circuit diagram of an open-loop control device.

In the drafting device of FIG. 5, the feed roller 10 (which, as the delivery roller, also takes the fibre material 19 off from the feed shaft 9) is driven by an electric drive motor 30, which revolves preferably at from 10 to 15 m/min, for example 12 m/min. An electronic control and regulation device 31 having a memory element 32 is provided, to which control and regulation device there are connected the drive motor 30 for the feed roller 10, the drive motor 33 for the lower roller I, the drive motor 34 for the lower rollers II (the upper rollers 22 and 23, respectively, rotate as a result of engagement with the lower rollers) and an inductive displacement sensor 16 associated with the feed trough 14. By means of the open-loop control device 31 shown, the circumferential speeds and the speed ratio of the roller pairs 22/I and 23/II can be modified (open-loop-controlled) in suitable manner, as a result of which the weight of the flock web 27*c* can be changed.

Figure 6:
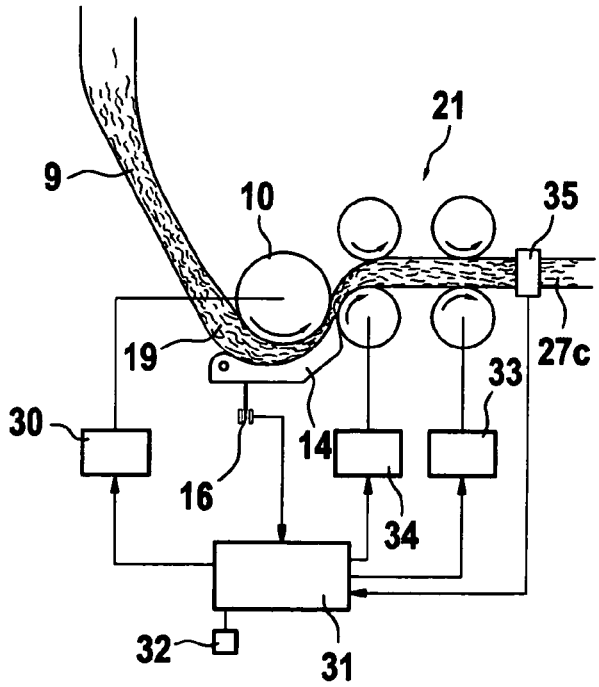
FIG. 6 shows the feed device of a flock feeder, a flock drafting mechanism arranged immediately downstream of the feed device, the fibre material and the generalised circuit diagram of a closed-loop control device.

In the embodiment of FIG. 6, an element 35 for measuring the mass of the drafted flock web 27*c* is additionally connected to the electronic control and regulation device 31 and forms the measuring element of a closed-loop control circuit. The measuring element 35 is arranged at the exit from the drafting mechanism 21. By that means, using the closed-loop control device shown, a prespecified web weight is kept at the desired value, the desired value being provided in the desired value memory 32.

Figure 7:
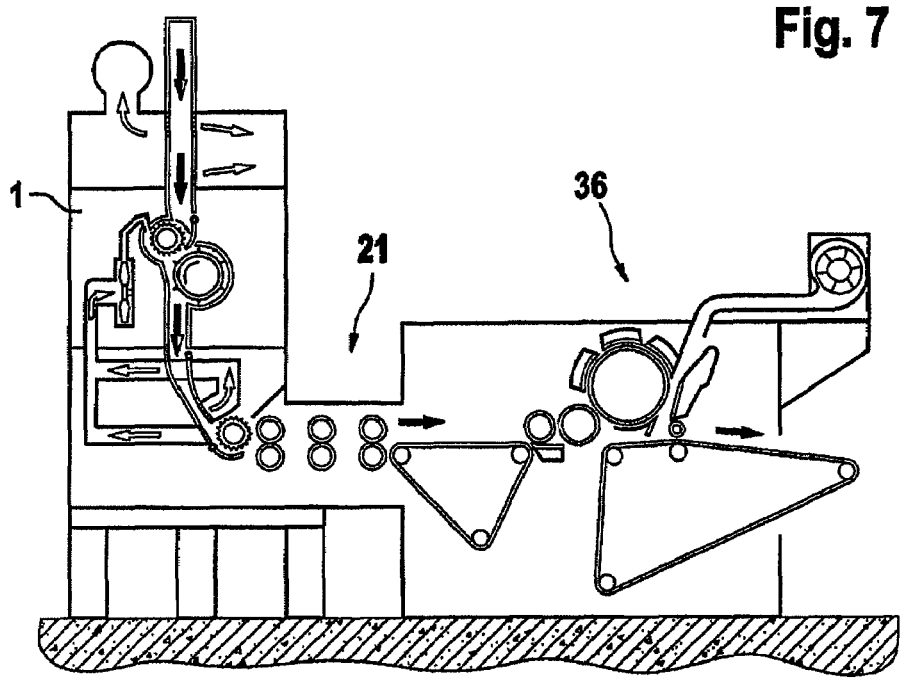
FIG. 7 is a diagrammatic side view of another apparatus according to the invention having a 3-over-3 drafting mechanism between a flock feeder device and an aerodynamic web-former.

In the embodiment of FIG. 7, a 3-over-3 drafting mechanism 21 is arranged between the flock feeder device 1 and an aerodynamic web-former 36, for example a "Turbo-Unit" from the Dilo-Spinnbau company. As a result of drafting of the flock web 27, a high degree of uniformity is obtained for the flock web feed 27*c*, which is fed into the web-former 36. The non-woven web produced has a web weight of between 100 and 3000 g/m$^2$ and is used, for example, in the hygiene and automotive sectors.

Figure 8:
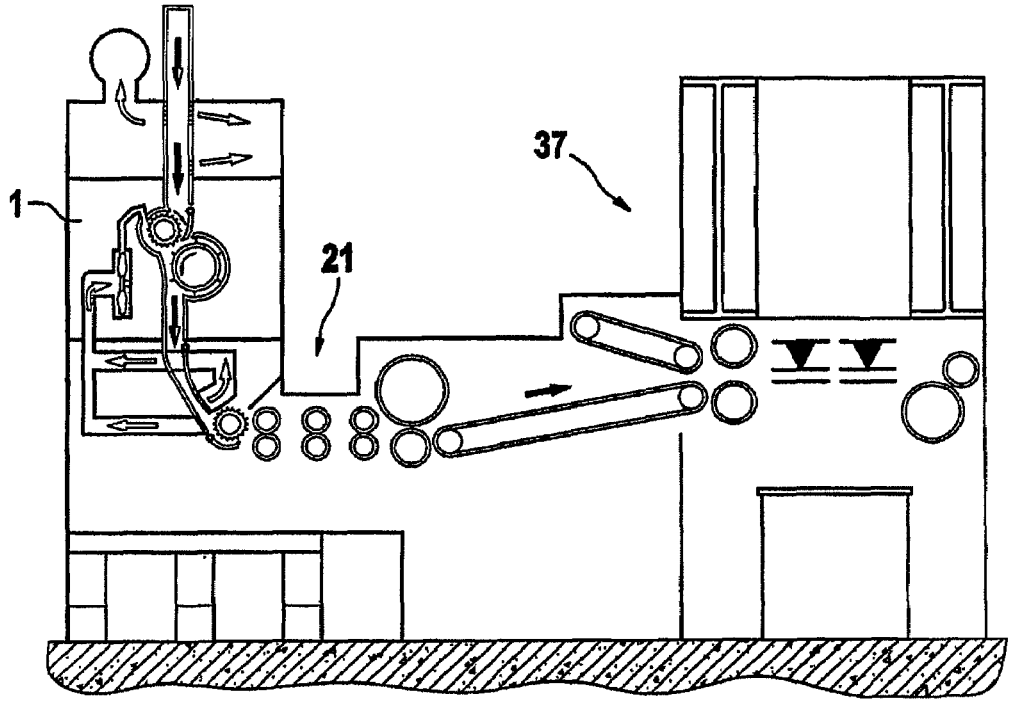
FIG. 8 is a diagrammatic side view of a further apparatus according to the invention having a 3-over-3 drafting mechanism between a flock feeder device and a needling machine.

In the embodiment of FIG. 8, a 3-over-3 drafting mechanism 21 is provided between the flock feeder device 1 and a needling machine 37. In this embodiment, the flock feeder 1 acts as web-former, and the needling machine 37 operates as a web-bonder. For the production of simple coarse non-wovens (for example, insulating webs in the automobile sector) having web weights in the range 600 to 2000 g/m$^2$, the coupling of the flock feeder device 1 with the needling machine 37 is advantageous.

Figure 9:
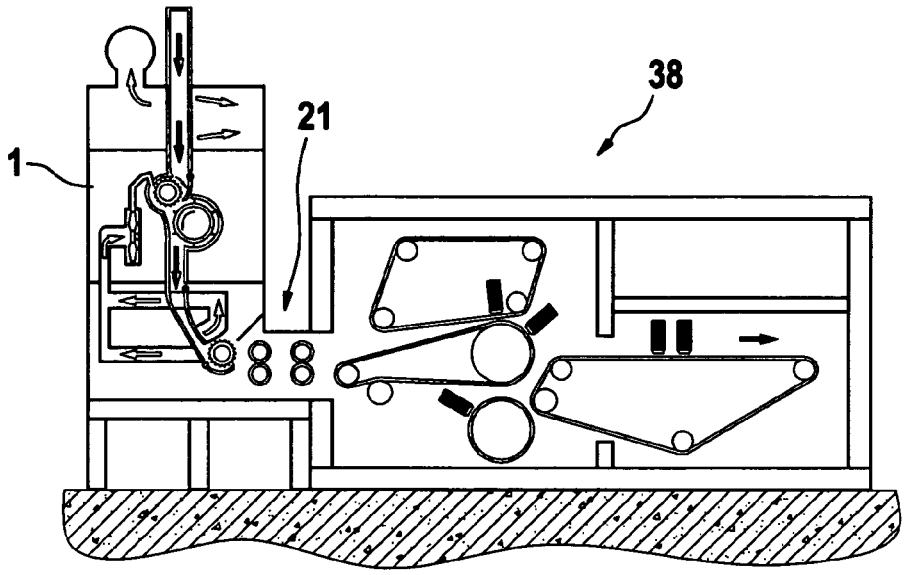
FIG. 9 shows a further embodiment of the invention, having a 2-over-2 drafting mechanism between a flock feeder device and a hydroentanglement bonding unit.

In the embodiment of FIG. 9, a 2-over-2 drafting mechanism 21 is provided between a flock feeder device 1 and a hydroentanglement bonding unit 38. Compared to needling technology, hydroentanglement bonding is advantageous especially in the case of relatively light web weights.

Figure 10:
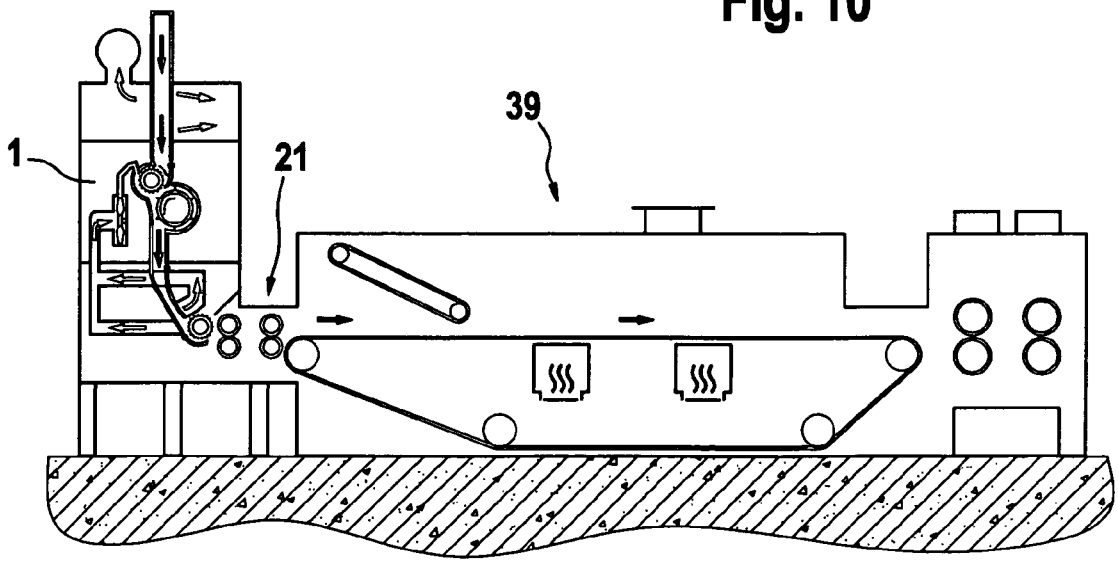
FIG. 10 shows yet another embodiment of the invention, having a 2-over-2 drafting mechanism between a flock feeder device and a thermofusion oven.

In the embodiment of FIG. 10, a 2-over-2 drafting mechanism is arranged between a flock feeder device 1 and a thermofusion oven 39. By this means, high-volume filler materials (non-woven webs) produced using thermoplastic fibre raw materials are achieved by coupling the flock feeder device 1 and the thermofusion oven 39. In this arrangement, the flock feeder device 1 acts as web-former, and the thermofusion oven 39 effects thermal bonding.

Located in the feed shaft 9 of the flock feeder device 1 is a flock charge 19 which is compacted and evened out pneumatically. The feed device comprising a feed roller 10 and a feed trough 14 delivers a fibre flock web 27*a* which passes through the nip between the rollers 23/II, in the course of which it is compacted. The fibre flock web 27*b* is drafted and made more uniform in the drafting zone and it passes through the nip between the rollers 22/I, in the course of which it is further compacted.

In all cases of machines provided downstream of the drafting apparatus, that is to say the web-former 36 and web-bonder 37, 38, 39, it is advantageous for the fibre flock web 27 to be made more uniform by means of drafting. When a web-bonder 37, 38, 39 is provided downstream of the drafting apparatus, compaction of the fibre flock web by the drafting apparatus is advantageous, as a result of which pre-bonding is accomplished.

The web-former 36 and the web-bonders 37, 38, 39 deliver a fibre web.

In accordance with the invention, the emerging web is drafted between two or more downstream roller pairs (FIGS. 1 to 10) by increasing the circumferential speed of the roller pairs following one another in the direction of the material flow.

Because the structure of the delivered flock web requires a drafting point that is as defined as possible whereas the working widths of the web-forming machines necessitate large roller diameters, the physical drafting zone is matched to the specific structure of a flock web with the aid of the pressure bar 25, that is to say is concentrated at a particular point.

Figure 11:
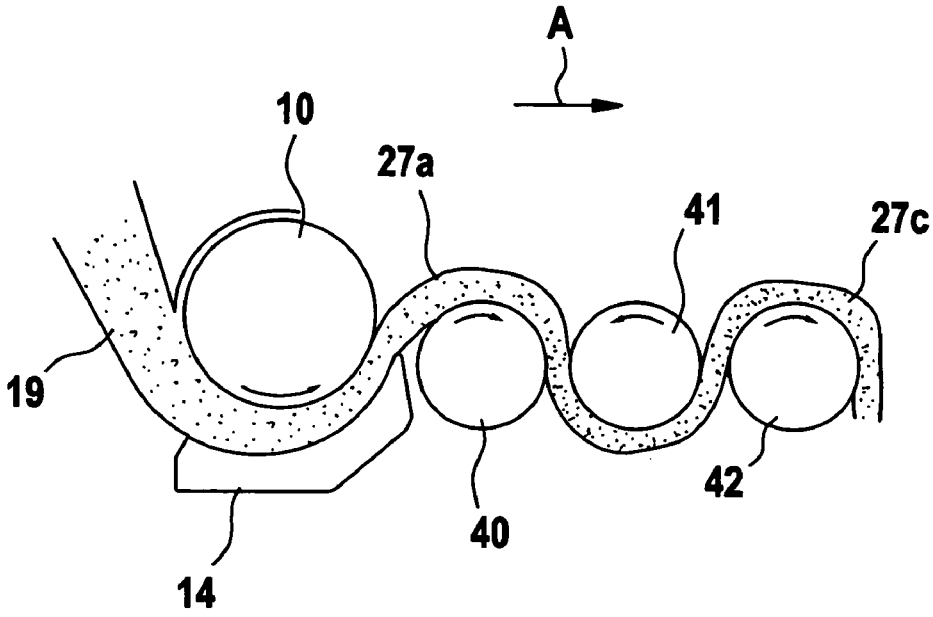
FIG. 11 is a partial view of a further apparatus according to the invention including a drafting device in the form of three rollers arranged one after the other.

FIG. 11 shows a further arrangement of the apparatus according to the invention comprising three rollers 40, 41, 42 arranged one after the other as drafting device. The circumferential speeds of the rollers 40, 41, 42 increase in the work direction A. The directions of rotation of neighbouring rollers 40, 41, 42 are contrary to one another. The surfaces of the rollers 40, 41, 42 can be provided with contouring or the like (not shown), which promotes engagement with the fibre flock web 27. The fibre flock web 27 loops around part of the surface of neighbouring rollers 40, 41 and 42 on different sides. As a result, the fibre flock web 27 is drafted on different sides by neighbouring rollers 40, 41, 42.

The term "drafting device" as used herein includes any device which is able to effect drawing out of the fibre material, reducing the weight per unit area of the fibre material. As will be apparent from the above description, such devices include both devices in which drafting occurs between pairs of cooperating rollers (for example as shown in FIGS. 1 to 10) and devices in which the drafting is effected by passing the fibre material around two or more consecutively arranged rollers (for example, as shown in FIG. 11), as well as any other forms of device suitable for effecting the desired drafting action.

The drafting devices of any of FIGS. 2 to 11 may, in accordance with the invention, be used with the flock feeder device 1 shown in FIG. 1 or with any other suitable flock feeder device. Corresponding or like parts are indicated by the same reference numerals in each of the embodiments shown and separate description thereof in respect of each embodiment is superfluous.

Although the foregoing invention has been described in detail by way of illustration and example for purposes of understanding, it will be obvious that changes and modifications may be practised within the scope of the appended claims.

What is claimed is:

1. An apparatus for producing a fibre web, comprising:

a flock-feeding device;

a drafting device located downstream from the flock-feeding device, the drafting device adapted to draft fibre material conveyed from the flock-feeding device; and a web-forming device arranged downstream from the drafting device, the web-forming device adapted to form a web from fibre material received from the drafting device.

2. An apparatus according to claim 1, wherein the drafting device comprises driven rollers.

3. An apparatus according to claim 2, wherein circumferential speeds of the driven rollers increase in the work direction.

4. An apparatus according to claim 1, wherein the drafting device comprises at least two co-operating roller pairs.

5. An apparatus according to claim 4, wherein the roller pairs are arranged after one another.

6. An apparatus according to claim 4, wherein the apparatus includes at least some closed-loop and/or open-loop control of a speed of rotation of the roller pairs.

7. An apparatus according to claim 1, wherein the drafting device comprises a 2-over-2drafting mechanism.

8. An apparatus according to claim 1, wherein the drafting device comprises a 3-over-3drafting mechanism.

9. An apparatus according to claim 1, wherein the drafting device comprises an autoleveller drafting mechanism.

10. An apparatus according to claim 1, wherein the flock-feeding device has delivery rollers that also constitute intake rollers of the drafting device.

11. An apparatus according to claim 1, wherein the drafting device comprises a roller group having two upper rollers located above the fibre material and one lower roller located below the fibre material.

12. An apparatus according to claim 1, wherein the drafting device comprises a roller group having two lower rollers located below the fibre material and one upper roller located above the fibre material.

13. An apparatus according to claim 1, further comprising at least a first roller and a second roller arranged in succession.

14. An apparatus according to claim 13, wherein the first roller and the second roller define a roller nip, and the fibre material passes through the roller nip.

15. An apparatus according to claim 13, wherein the first roller is located above the fibre material and the second roller is located below the fibre material.

16. An apparatus according to claim 13, wherein the fibre material includes a first side and a second side, and the first side is drafted on the first roller, and the second side is drafted on the second roller.

17. An apparatus according to claim 13, wherein drafting of the fibre material on a roller is different on the surface that faces the roller and on the surface that is remote from the roller.

18. An apparatus according to claim 1, wherein the drafting device is adapted to pre-bond the fibre material.

19. An apparatus according to claim 1, wherein the drafting device comprises intake rollers that have a circumferential speed of 1 to 35 meters per minute.

20. An apparatus according to claim 1, wherein the drafting device is adapted for a degree of drafting of 1.5 to 4 times.

21. An apparatus according to claim 1, wherein the drafting device comprises an electrical control and/or regulation device having a desired value setter.

22. An apparatus according to claim 1, wherein the drafting device comprises a control and/or regulation device having a measuring device for the flock material mass, and an actuating device.

23. An apparatus according to claim 22, wherein the actuating device comprises an adjustable-speed motor adapted to drive at least one roller of the drafting device.

24. An apparatus according to claim 1, wherein the drafting device includes a first roller and a second roller, the apparatus further comprising one or more adjustable-speed motors adapted to modify drafting between the first roller and the second roller.

25. An apparatus according to claim 1, further comprising closed-loop-controllable motors adapted to modify drafting between successive roller pairs.

26. An apparatus according to claim 1, wherein the web-forming device comprises a web former arranged downstream of the drafting device, the web former adapted to form a loose web of fibre material for use in a subsequent spinning room process.

27. An apparatus according to claim 26, wherein the web-former is selected from the group consisting of roller cards and aerodynamic web-formers.

28. A method of producing a non-woven web, comprising using the apparatus of claim 1 and regulating the weight per unit area of the non-woven web.

29. An apparatus for producing a fibre web, comprising:

a flock-feeding device;

a web-forming device; and a drafting device arranged between the flock-feeding device and the web-forming device for drafting fibre material that, in use, is conveyed from the flock-feeding device to the web-forming device, wherein the drafting device has one or more drafting zones and includes at least one pressure bar in at least one of the drafting zones.

30. An apparatus for producing a fibre web, comprising:

a flock-feeding device;

a web-forming device; and a drafting device arranged between the flock-feeding device and the web-forming device for drafting fibre material that, in use, is conveyed from the flock-feeding device to the web-forming device, wherein the web-forming device comprises a web-bonder and the web-bonder is selected from the group consisting of needling machines, thermofusion devices, spunlace devices, and hydroentanglement bonding devices.

* * * * *

UNITED STATES PATENT AND TRADEMARK OFFICE

CERTIFICATE OF CORRECTION

PATENT NO. : 7,627,932 B2
APPLICATION NO. : 11/205217
DATED : December 8, 2009
INVENTOR(S) : Bernhard Rübenach It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1146 days.

Signed and Sealed this

Second Day of November, 2010

David J. Kappos

David J. Kappos
*Director of the United States Patent and Trademark Office*